US011187004B2

(12) United States Patent
Narvaez-Newman

(10) Patent No.: US 11,187,004 B2
(45) Date of Patent: Nov. 30, 2021

(54) UMBRELLA STAND ASSEMBLY

(71) Applicant: Gloria Narvaez-Newman, Thornwood, NY (US)

(72) Inventor: Gloria Narvaez-Newman, Thornwood, NY (US)

( * ) Notice: Subject to any disclaimer, the term of this patent is extended or adjusted under 35 U.S.C. 154(b) by 0 days.

(21) Appl. No.: 16/854,363

(22) Filed: Apr. 21, 2020

(65) Prior Publication Data

US 2021/0324653 A1 Oct. 21, 2021

(51) Int. Cl.
*A45B 23/00* (2006.01)
*E04H 12/22* (2006.01)

(52) U.S. Cl.
CPC ..... *E04H 12/2223* (2013.01); *A45B 23/00* (2013.01); *A45B 2023/0012* (2013.01)

(58) Field of Classification Search
None
See application file for complete search history.

(56) References Cited

U.S. PATENT DOCUMENTS 2,765,168 A * 10/1956 Taylor ..... A63G 1/30 472/33
4,832,304 A * 5/1989 Morgulis ..... A01K 97/10 135/16
5,152,495 A 10/1992 Jacinto
5,293,889 A 3/1994 Hall
5,482,246 A 1/1996 Derkoski
D394,544 S 5/1998 Tropiano
6,715,503 B2 * 4/2004 Brooks, III ..... A45B 3/00 135/16
7,007,703 B2 3/2006 Brooks
8,191,561 B2 * 6/2012 Brooks, III ..... E04H 12/2223 135/16
9,591,939 B2 * 3/2017 Rothenberg ..... A47G 33/00
9,629,427 B1 4/2017 Alm
9,675,146 B1 * 6/2017 Howell ..... F16M 11/041
10,602,817 B2 * 3/2020 Price ..... A45B 23/00
2002/0185167 A1 * 12/2002 Lin ..... A45B 25/22 135/16
2005/0211282 A1 9/2005 DeVenezia
2015/0108295 A1 * 4/2015 Brooks ..... F16M 11/242 248/156

FOREIGN PATENT DOCUMENTS

EP 0687785 12/1995

* cited by examiner

*Primary Examiner* — Steven M Marsh

(57) ABSTRACT

An umbrella stand assembly includes an auger that is insertable into a granular support surface. A plurality of pivots is each of the pivots is coupled to and extends laterally away from the auger. A plurality of paddles is each of the paddles is pivotally coupled to a respective one of the pivots. Each of the paddles is positionable in a deployed position has each of the paddles to rest on the granular support surface when the auger is driven into the granular support surface. In this way the auger is stabilized with respect to a vertical axis. A tube extends upwardly from the auger and insertably receives a pole of an umbrella. In this way the umbrella is positioned above the granular support surface for shade.

8 Claims, 5 Drawing Sheets

UMBRELLA STAND ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to stand devices and more particularly pertains to a new stand device for standing an umbrella on a granular support surface.

(2) Description of Related Art Including Information Disclosed Under 37 CFR 1.97 and 1.98

The prior art relates to stand devices. The prior art discloses an auger that can be driven into sand or loose dirt that includes a tube for receiving a pole of an umbrella. Additionally, the prior art discloses a screw that can be screwed into the ground and that has a tube thereon for receiving a pole of an umbrella. Additionally, the prior art discloses an auger that can be driven into ground that includes a plurality of legs being pivotally coupled thereto for stabilizing the auger and that includes a tube for receiving a pole of an umbrella. None of the prior art discloses a plurality of paddles that are pivotally coupled to an auger for supporting an umbrella such as is disclosed in this application.

BRIEF SUMMARY OF THE INVENTION

An embodiment of the disclosure meets the needs presented above by generally comprising an auger that is insertable into a granular support surface. A plurality of pivots is each of the pivots is coupled to and extends laterally away from the auger. A plurality of paddles is each of the paddles is pivotally coupled to a respective one of the pivots. Each of the paddles is positionable in a deployed position has each of the paddles to rest on the granular support surface when the auger is driven into the granular support surface. In this way the auger is stabilized with respect to a vertical axis. A tube extends upwardly from the auger and insertably receives a pole of an umbrella. In this way the umbrella is positioned above the granular support surface for shade.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
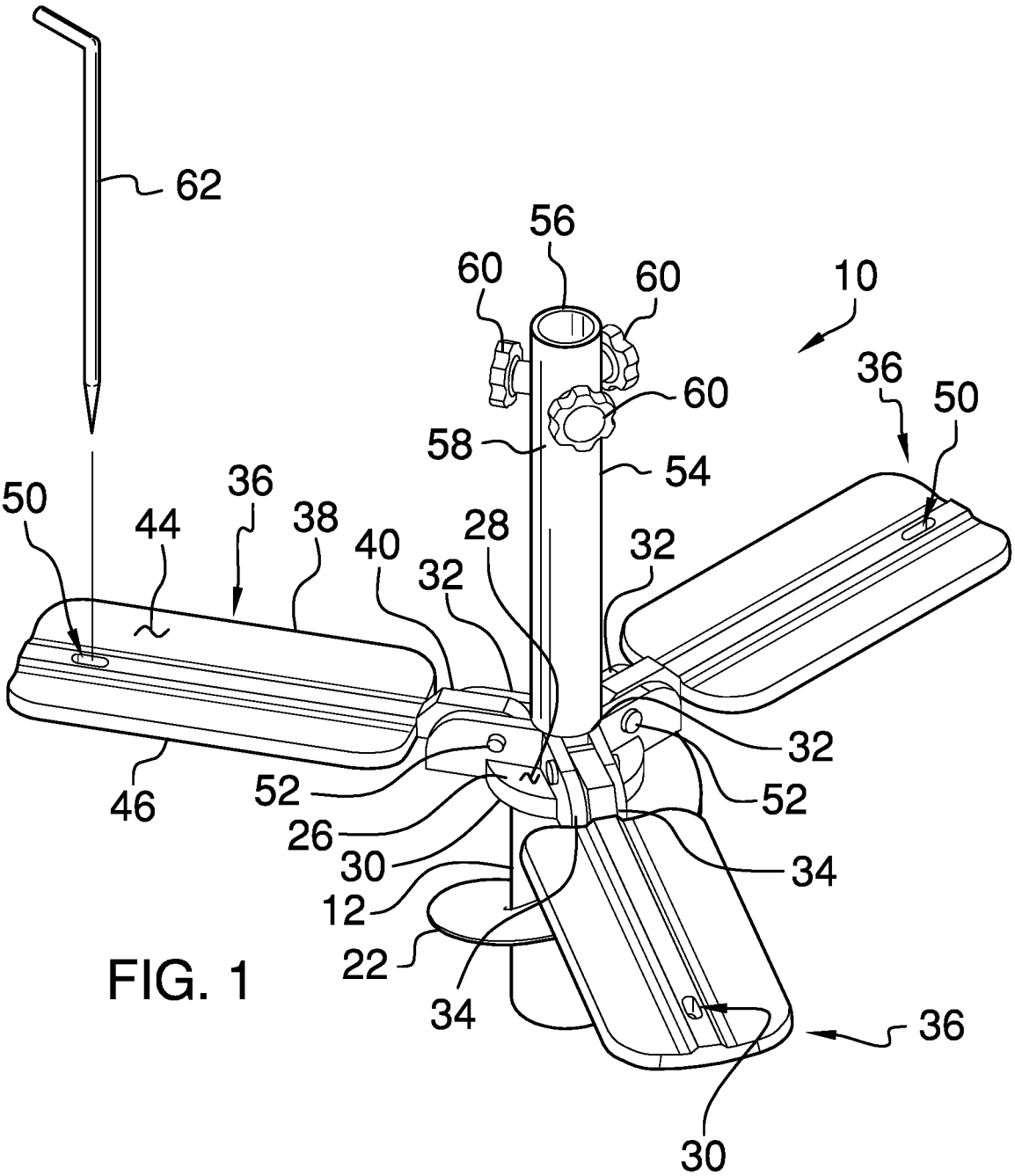
FIG. 1 is a top perspective view of an umbrella stand assembly according to an embodiment of the disclosure.
Figure 2:
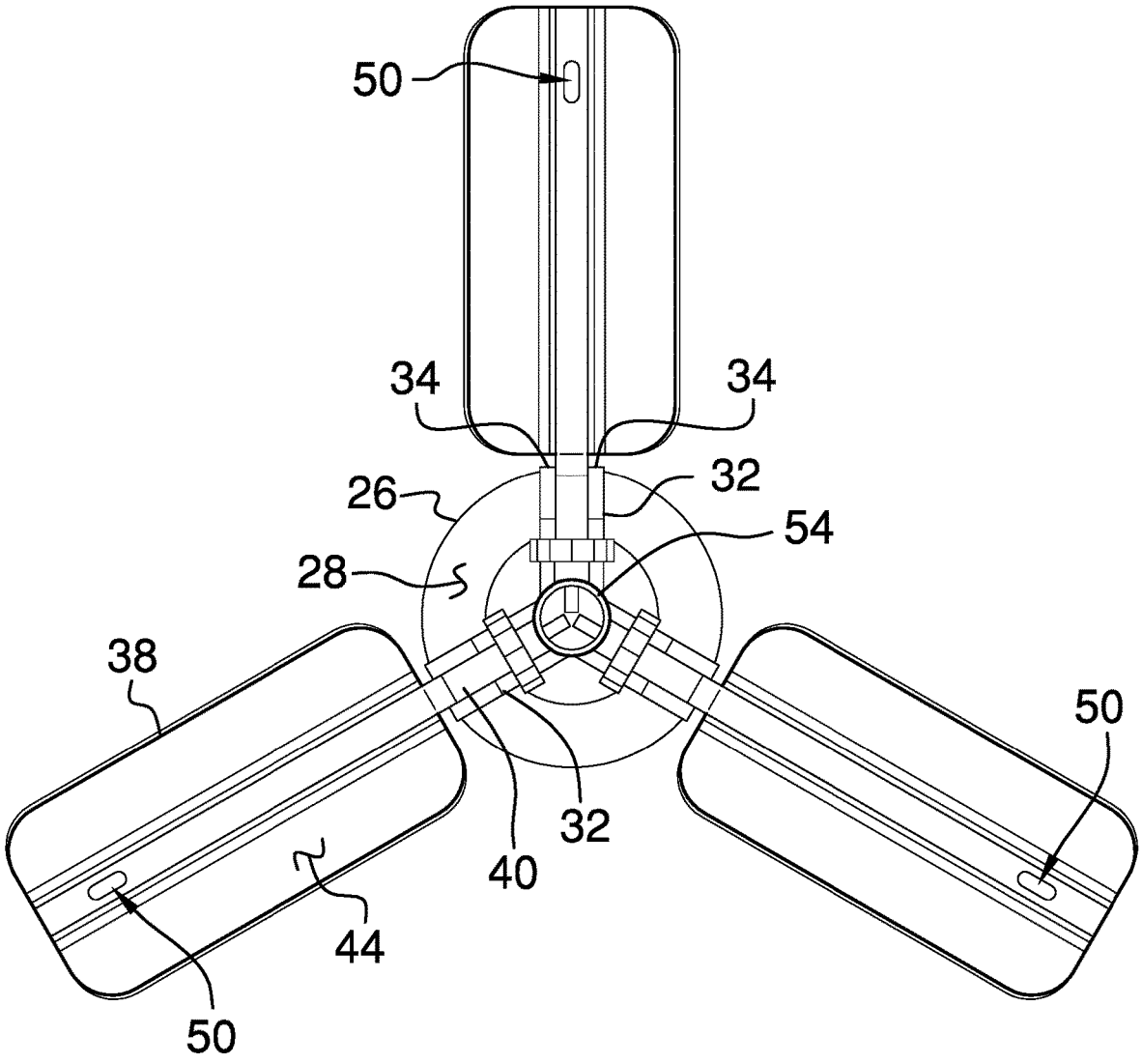
FIG. 2 is a top view of an embodiment of the disclosure showing a plurality of paddles in a deployed position.
Figure 3:
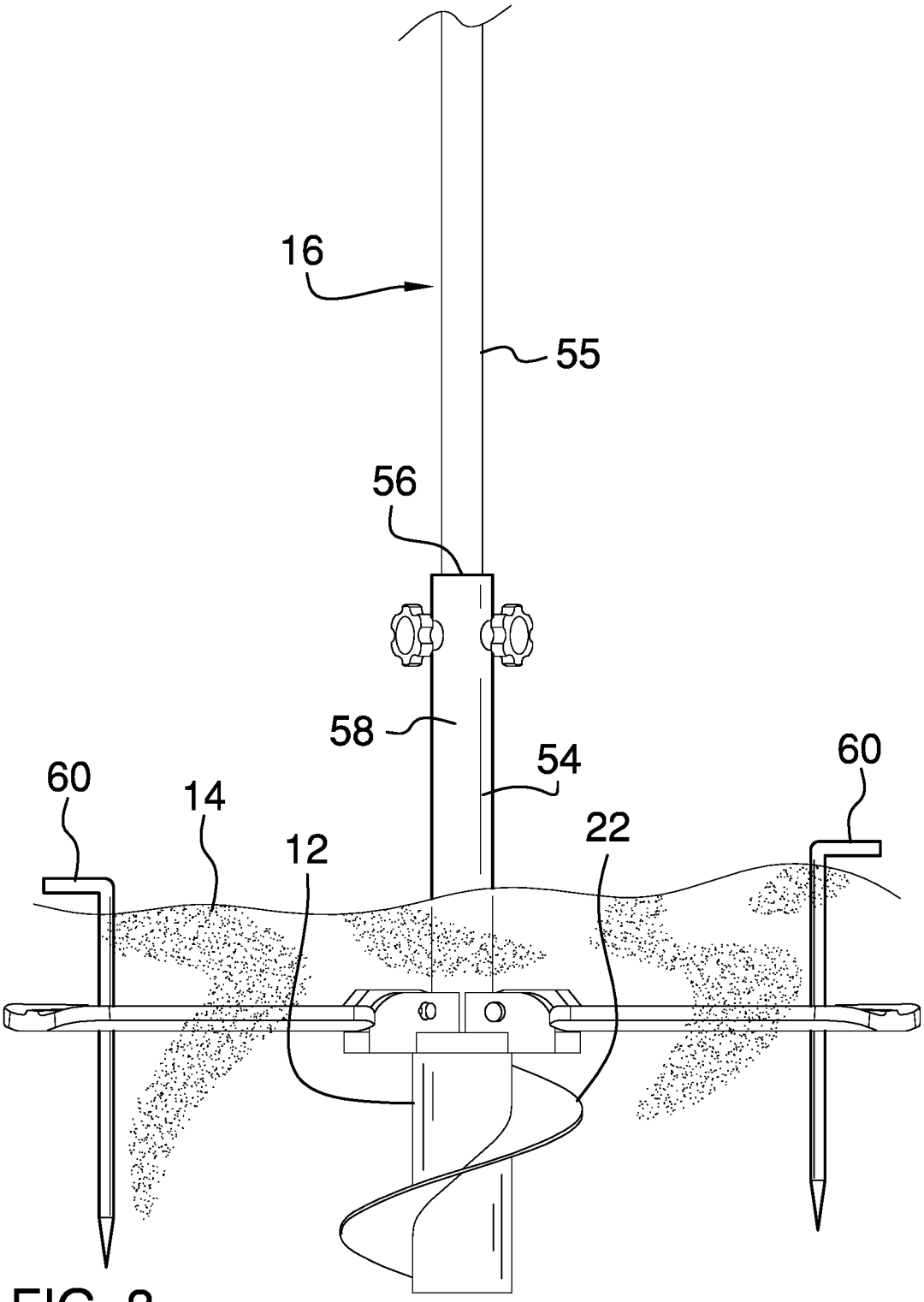
FIG. 3 is a perspective in-use view of an embodiment of the disclosure.
Figure 4:
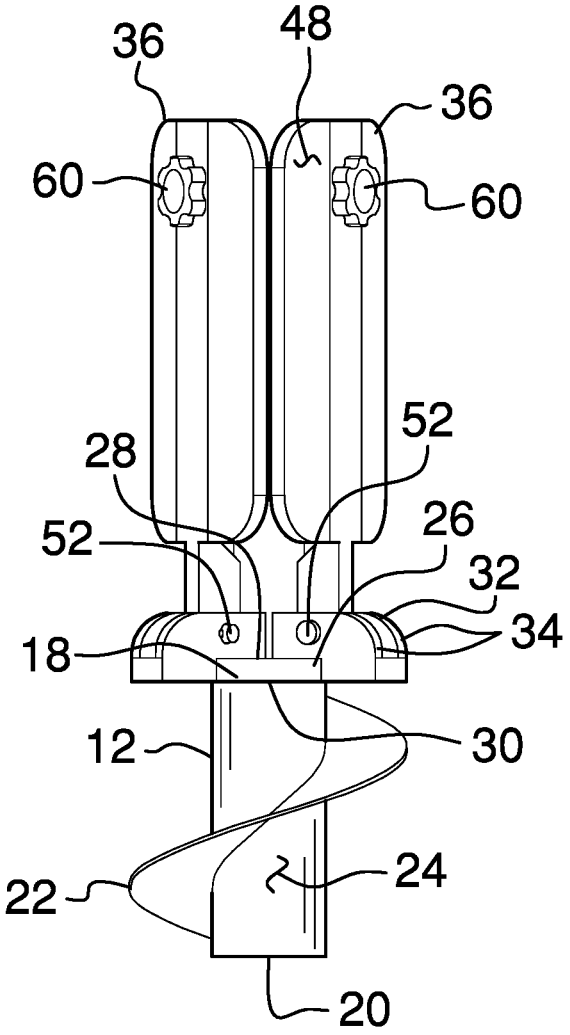
FIG. 4 is a front view of an embodiment of the disclosure showing a plurality of paddles in a stored position.
Figure 5:
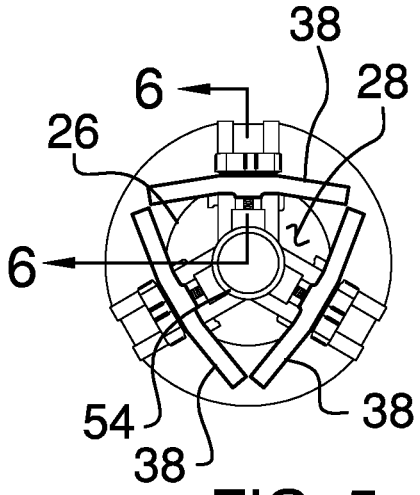
FIG. 5 is a top view of an embodiment of the disclosure showing a plurality of paddles in a stored position.
Figure 6:
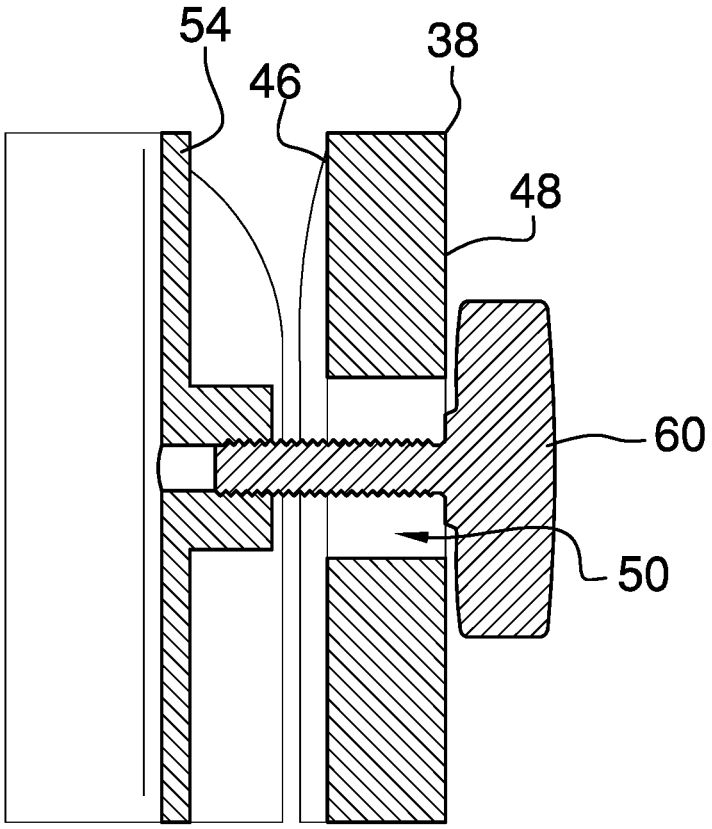
FIG. 6 is a cross sectional view taken along line 6-6 of FIG. 5 of an embodiment of the disclosure.

With reference now to the drawings, and in particular to FIGS. 1 through 6 thereof, a new stand device embodying the principles and concepts of an embodiment of the disclosure and generally designated by the reference numeral 10 will be described.

As best illustrated in FIGS. 1 through 6, the umbrella stand assembly 10 generally comprises an auger 12 that is insertable into a granular support surface 14. The granular support surface 14 may be sand at a beach or other similar area upon which an umbrella 16 would stand for the purposes of shade. The auger 12 has a top end 18, a bottom end 20 and a blade 22 extending around an outer surface 24 of the auger 12. The blade 22 curves around the outer surface 24 and extends between the top end 18 and the bottom end 20. Thus, the blade 22 defines a helical coil extending around the auger 12. In this way the blade 22 can engage the granular support surface 14 when the auger 12 is rotated for urging the auger 12 downwardly into the granular support surface 14.

A disk 26 is included that has an upper surface 28 and a lower surface 30, and the lower surface 30 is attached to the top end 18 of the auger 12. Moreover, the disk 26 has a diameter that is greater than the diameter of the auger 12. In this way the disk 26 inhibits the depth to which the auger 12 can be driven into the granular support surface 14. A plurality of pivots 32 is each coupled to and extends laterally away from the auger 12. The pivots 32 are spaced apart from each other and are distributed around a full circumference of the auger 12. Each of the pivots 32 is positioned on the upper surface 28 of the disk 26. Additionally, each of the pivots 32 comprises a pair of fingers 34 that are spaced apart from each other and which extend laterally away from the disk 26.

A plurality of paddles 36 is each pivotally coupled to a respective one of the pivots 32. Each of the paddles 36 is positionable in a stored position having each of the paddles 36 extending upwardly from the auger 12. Additionally, each of the paddles 36 is positionable in a deployed position having each of the paddles 36 extending laterally away from the auger 12. Thus, each of the paddles 36 rests on the granular support surface 14 when the auger 12 is driven into the granular support surface 14 for stabilizing the auger 12 with respect to a vertical axis.

Each of the paddles 36 comprises a panel 38 extending away from a coupling 40. The panel 38 has a distal end 42 with respect to the coupling 40, and the panel 38 has a top surface 44 and a bottom surface 46. The coupling 40 of each of the paddles 36 is positioned between the fingers 34 of a respective one of the pivots 32. The panel 38 has a top surface 44 and a bottom surface 46, and the top surface 44 has a ridge 48 extending between the coupling 40 and the distal end 42 of the panel 38. The panel 38 has a slot 50 extending through the top surface 44 and the bottom surface 46, and the slot 50 is positioned adjacent to the distal end 42 of the panel 38. A plurality of pins 52 is provided and each of the pins 52 extends through the fingers 34 of a respective one of the pivots 32 and extends through the coupling 40 positioned in the respective pivot 32. In this way the coupling 40 is pivotally retained in the respective pivot 32.

A tube 54 extends upwardly from the auger 12 to insertably receive a pole 55 of the umbrella 16 thereby facilitating the umbrella 16 to be positioned above the granular support surface 14 for shade. The tube 54 is coupled to the upper surface 28 of the disk 26 and the tube 54 is centrally positioned between each of the pivots 32. Additionally, the tube 54 has a distal end 56 with respect to the disk 26 and an outer wall 58. The tube 54 may have a length ranging between approximately 12.0 inches and 24.0 inches.

A plurality of screws 60 is provided and each of the screws 60 extends through the tube 54. Each of the screws 60 engages a respective one of the paddles 36 for retaining the respective paddle 36 in the stored position. Each of the screws 60 is removable from the respective paddle 36 to facilitate the respective paddle 36 to be positioned in the deployed position. Each of the screws 60 is extendable through the slot 50 in the respective paddle 36 when the respective paddle 36 is in the stored position.

A plurality of spikes 62 is provided and each of the spikes 62 is insertable through a respective one of the paddles 36 when the respective paddle 36 is in the deployed position. In this way each of the spikes 62 can pierce the granular support surface 14 to inhibit the respective paddle 36 from moving on the granular support surface 14. Each of the spikes 62 is extendable through the slot 50 in the respective paddle 36.

In use, the auger 12 is driven into the granular support surface 14 and each of the paddles 36 is positioned in the deployed position. Each of the spikes 62 is driven through the respective paddle 36 to inhibit the respective paddle 36 from moving. Additionally, the granular material comprising the granular support surface 14 is backfilled on top of each of the paddles 36 for enhancing stability of the paddles 36. The umbrella pole 55 is inserted into the tube 54 thereby facilitating the auger 12 and each of the paddles 36 to retain the umbrella 16 in a vertical orientation. In this way the umbrella 16 can be employed on the beach or other location with sand without the risk of the umbrella 16 being tipped over or blown away by wind.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An umbrella stand assembly for securing an umbrella in granular soil thereby inhibiting the umbrella from being blown by wind, said assembly comprising:

an auger being insertable into a granular support surface, said auger having a top end, a bottom end and a blade extending around an outer surface of said auger, said blade curving around said outer surface and extending between said top end and said bottom end such that said blade defines a helical coil extending around said auger wherein said blade is configured to engage the granular support surface when said auger is rotated for urging said auger downwardly into the granular support surface;

a plurality of pivots, each of said pivots being coupled to and extending laterally away from said auger, said pivots being spaced apart from each other and being distributed around a full circumference of said auger;

a plurality of paddles, each of said paddles being pivotally coupled to a respective one of said pivots, each of said paddles being positionable in a stored position having each of said paddles extending upwardly from said auger, each of said paddles being positionable in a deployed position having each of said paddles extending laterally away from said auger wherein each of said paddles is configured to rest on the granular support surface when said auger is driven into the granular support surface for stabilizing said auger with respect to a vertical axis;

a tube extending upwardly from said auger wherein said tube is configured to insertably receive a pole of an umbrella thereby facilitating the umbrella to be positioned above the granular support surface for shade;

a plurality of spikes, each of said spikes being insertable through a respective one of said paddles when said respective paddle is in said deployed position wherein each of said spikes is configured to pierce the granular support surface to inhibit said respective paddle from moving on the granular support surface; and a disk having an upper surface and a lower surface, said lower surface being attached to said top end of said auger, said disk having a diameter being greater than the diameter of said auger.

2. The assembly according to claim 1, wherein each of said pivots is positioned on said upper surface of said disk, each of said pivots comprising a pair of fingers being spaced apart from each other and extending laterally away from said disk.

3. The assembly according to claim 1, wherein:

each of said pivots is positioned on said upper surface of said disk, each of said pivots comprising a pair of fingers being spaced apart from each other and extending laterally away from said disk; and each of said paddles comprises a panel extending away from a coupling, said panel having a distal end with respect to said coupling, said panel having a top surface and a bottom surface, said coupling of each of said paddles being positioned between said fingers of a respective one of said pivot.

4. The assembly according to claim 3, wherein said panel has a top surface and a bottom surface, said top surface having a ridge extending between said coupling and said distal end of said panel, said panel having a slot extending through said top surface and said bottom surface, said slot being positioned adjacent to said distal end of said panel.

5. The assembly according to claim 3, further comprising a plurality of pins, each of said pins extending through said fingers of a respective one of said pivots and extending through said coupling positioned in said respective pivot for pivotally retaining said coupling in said respective pivot.

6. The assembly according to claim 1, wherein said tube is coupled to said upper surface of said disk having said tube being centrally positioned between each of said pivots, said tube having a distal end with respect to said disk and an outer wall.

7. The assembly according to claim 4, further comprising a plurality of screws, each of said screws extending through said tube, each of said screws engaging a respective one of said paddles for retaining said respective paddle in said stored position, each of said screws being removable from said respective paddle to facilitate said respective paddle to be positioned in said deployed position, each of said screws being extendable through said slot in said respective paddle when said respective paddle is in said stored position.

8. An umbrella stand assembly for securing an umbrella in granular soil thereby inhibiting the umbrella from being blown by wind, said assembly comprising:

an auger being insertable into a granular support surface, said auger having a top end, a bottom end and a blade extending around an outer surface of said auger, said blade curving around said outer surface and extending between said top end and said bottom end such that said blade defines a helical coil extending around said auger wherein said blade is configured to engage the granular support when said auger is rotated for urging said auger downwardly into the granular support surface;

a disk having an upper surface and a lower surface, said lower surface being attached to said top end of said auger, said disk having a diameter being greater than the diameter of said auger;

a plurality of pivots, each of said pivots being coupled to and extending laterally away from said auger, said pivots being spaced apart from each other and being distributed around a full circumference of said auger, each of said pivots being positioned on said upper surface of said disk, each of said pivots comprising a pair of fingers being spaced apart from each other and extending laterally away from said disk;

a plurality of paddles, each of said paddles being pivotally coupled to a respective one of said pivots, each of said paddles being positionable in a stored position having each of said paddles extending upwardly from said auger, each of said paddles being positionable in a deployed position having each of said paddles extending laterally away from said auger wherein each of said paddles is configured to rest on the granular support surface when said auger is driven into the granular support surface for stabilizing said auger with respect to a vertical axis, each of said paddles comprising a panel extending away from a coupling, said panel having a distal end with respect to said coupling, said panel having a top surface and a bottom surface, said coupling of each of said paddles being positioned between said fingers of a respective one of said pivots, said panel having a top surface and a bottom surface, said top surface having a ridge extending between said coupling and said distal end of said panel, said panel having a slot extending through said top surface and said bottom surface, said slot being positioned adjacent to said distal end of said panel;

a plurality of pins, each of said pins extending through said fingers of a respective one of said pivots and extending through said coupling positioned in said respective pivot for pivotally retaining said coupling in said respective pivot;

a tube extending upwardly from said auger wherein said tube is configured to insertably receive a pole of an umbrella thereby facilitating the umbrella to be positioned above the granular support surface for shade, said tube being coupled to said upper surface of said disk having said tube being centrally positioned between each of said pivots, said tube having a distal end with respect to said disk and an outer wall;

a plurality of screws, each of said screws extending through said tube, each of said screws engaging a respective one of said paddles for retaining said respective paddle in said stored position, each of said screws being removable from said respective paddle to facilitate said respective paddle to be positioned in said deployed position, each of said screws being extendable through said slot in said respective paddle when said respective paddle is in said stored position; and a plurality of spikes, each of said spikes being insertable through a respective one of said paddles when said respective paddle is in said deployed position wherein each of said spikes is configured to pierce the granular support surface to inhibit said respective paddle from moving on the granular support surface, each of said spikes being extendable through said slot in said respective paddle.

* * * * *